US010677036B2

(12) United States Patent
Stolyarov et al.

(10) Patent No.: US 10,677,036 B2
(45) Date of Patent: Jun. 9, 2020

(54) INTEGRATED DATA DRIVEN PLATFORM FOR COMPLETION OPTIMIZATION AND RESERVOIR CHARACTERIZATION

(71) Applicants: Sergey Stolyarov, Tomball, TX (US); Junjie Yang, Edmond, OK (US); Sergey Kotov, Spring, TX (US); David Gadzhimirzaev, Houston, TX (US); Jason Wayne Simmons, Houston, TX (US)

(72) Inventors: Sergey Stolyarov, Tomball, TX (US); Junjie Yang, Edmond, OK (US); Sergey Kotov, Spring, TX (US); David Gadzhimirzaev, Houston, TX (US); Jason Wayne Simmons, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 75 days.

(21) Appl. No.: 15/940,406

(22) Filed: Mar. 29, 2018

(65) Prior Publication Data

US 2019/0301271 A1 Oct. 3, 2019

(51) Int. Cl.

| | |
|---|---|
| ***E21B 43/26*** | (2006.01) |
| ***E21B 41/00*** | (2006.01) |
| ***E21B 49/00*** | (2006.01) |
| *E21B 43/267* | (2006.01) |

(52) U.S. Cl.

CPC ..... *E21B 43/26* (2013.01); *E21B 41/0085* (2013.01); *E21B 49/00* (2013.01); *E21B 43/267* (2013.01)

(58) Field of Classification Search

CPC ..... E21B 43/26; E21B 49/00; E21B 41/0085; E21B 43/267

See application file for complete search history.

(56) References Cited

U.S. PATENT DOCUMENTS

| | | | | |
|---|---|---|---|---|
| 2008/0091396 | A1 | 4/2008 | Kennon et al. | |
| 2013/0140031 | A1* | 6/2013 | Cohen | E21B 43/26 166/308.1 |
| 2013/0158959 | A1 | 6/2013 | Gu et al. | |
| 2013/0133537 | A1 | 9/2013 | McEwen-King et al. | |
| 2014/0048270 | A1 | 2/2014 | Soliman et al. | |

FOREIGN PATENT DOCUMENTS

WO 2016085454 A1 6/2016

OTHER PUBLICATIONS

PCT International Search Report in PCT Application No. PCT/US2019/024460 dated Jul. 10, 2019, pp. 1-3.

PCT Written Opinion in PCT Application No. PCT/US2019/024460 dated Jul. 10, 2019, pp. 1-7.

* cited by examiner

*Primary Examiner* — Brad Harcourt

(74) *Attorney, Agent, or Firm* — Cantor Colburn LLP

(57) ABSTRACT

A method for performing a fracture operation. A log of a formation parameter is obtained for a formation surrounding a wellbore in which the fracture operation is to be implemented. A relation is determined between the formation parameter and a parameter of the fracture operation. A value of the parameter of the fracture operation is selected based on the relation and a value of the formation parameter.

12 Claims, 14 Drawing Sheets

Data Relationships (3) (Linear Regression)

| Y (numerical) | X (numerical) | p-value | FStat | RSq | R | Df | n |
|---|---|---|---|---|---|---|---|
| BreakDown | | 3.72E-002 | 4.75 | 0.14 | -0.37 | 30 | 32 |
| BreakDown | | 7.52E-002 | 3.40 | 0.10 | -0.32 | 30 | 32 |
| BreakDown | Average Rate | 9.05E-002 | 3.06 | 0.09 | -0.30 | 30 | 32 |
| BreakDown | | 6.18E-001 | 0.25 | 0.01 | 0.09 | 30 | 32 |
| BreakDown | Stage Length | 9.84E-001 | 0.00 | 0.00 | 0.00 | 30 | 32 |

Data table:
Data Relationships

INTEGRATED DATA DRIVEN PLATFORM FOR COMPLETION OPTIMIZATION AND RESERVOIR CHARACTERIZATION

BACKGROUND

In fracture operations performed on a formation or reservoir, a frac fluid is introduced into a wellbore penetrating the formation in order to break or fracture the formation, allowing an increased production of formation fluid from the formation. The hydrocarbons output from the wellbore depends on several parameters, such as a geometry of the fracture operation or equipment and a frac schedule. The geometry parameters include, for example, a spacing between wellbores, a location of a fracking stage, a spacing between fracking stages, stage length, etc. The frac schedule parameters can include a pump rate, a pump pressure, a proppant type, proppant mass, proppant concentration, etc. The hydrocarbons output from the formation can be maximized or increase by knowing how to set these parameters.

SUMMARY

A method for performing a fracture operation includes obtaining a log of a formation parameter for a formation surrounding a wellbore in which the fracture operation is to be implemented; determining a relation between the formation parameter and a parameter of the fracture operation; and selecting a value of the parameter of the fracture operation based on the relation and a value of the formation parameter.

A method of performing a fracture operation includes determining a relation between a fracture treatment parameter of the fracture operation and a formation parameter; determining, from the relation and a first value of the fracture treatment parameter, a value of the formation parameter; determining from the formation parameter a second value of the fracture treatment parameter; and altering the fracture treatment parameter from the first value to the second value.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
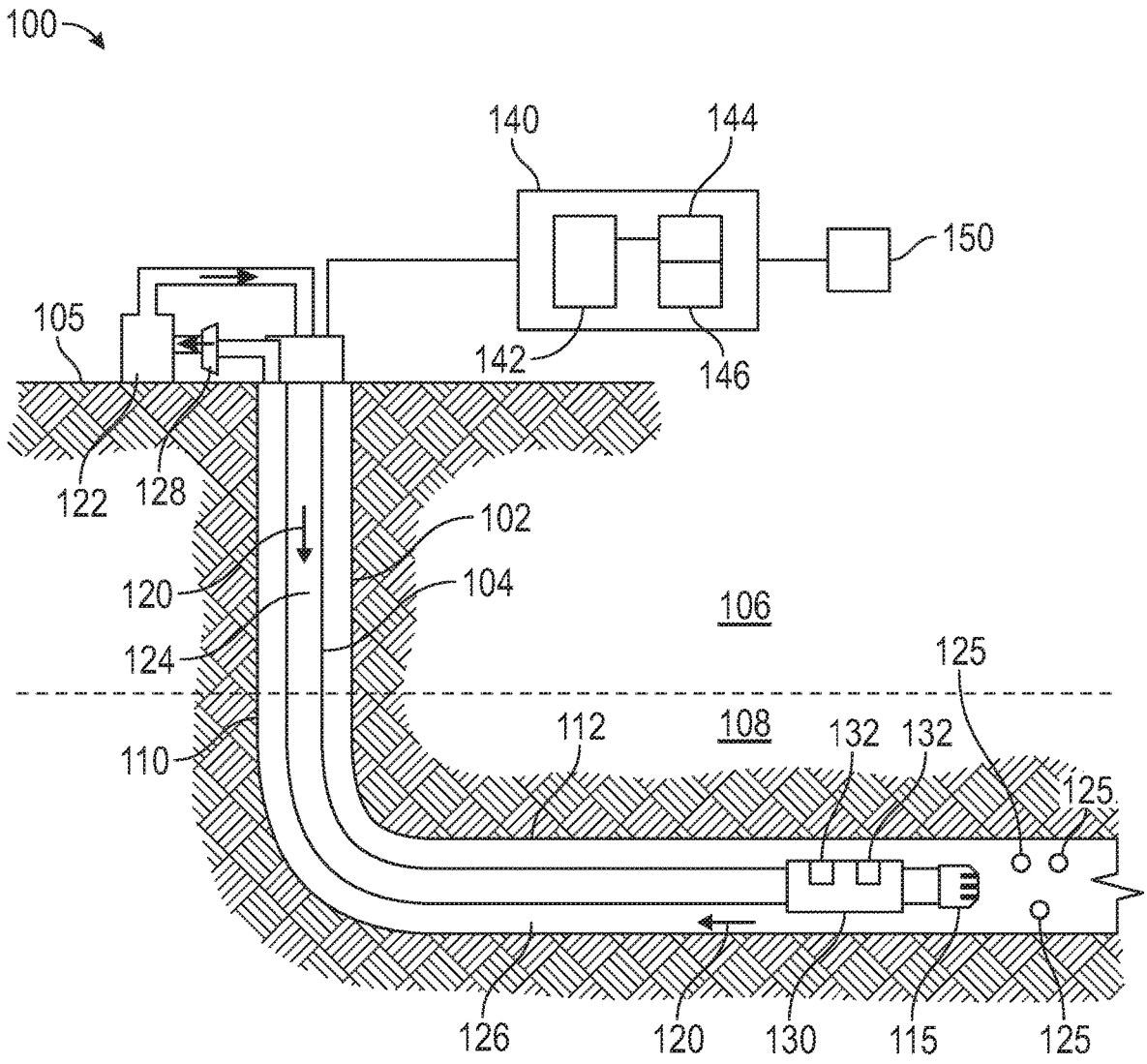
FIG. 1 depicts a drilling operation in a wellbore.

Referring to FIG. 1, a drilling operation 100 is shown in a wellbore 102. A drill string 104 is used to drill the wellbore 102 through an earth layer 106 and into a reservoir or formation 108 beneath the earth layer 106. At a selected depth, the drill string 104 is deviated from drilling a vertical section 110 of the wellbore to a drilling a deviated or lateral section 112 of the wellbore 102.

The drill string 104 includes a drill bit 115 at a bottom end for disintegrating the earth layer 106 and the formation 108 into cuttings 125. A drilling mud 120 is circulated from a mud pit 122 at the surface 105 to pass downhole through a bore 124 of the drill string 104 to exit into the wellbore 102 at the drill bit 115. Upon exiting the drill bit 115, the mud 120 is circulated back uphole via an annulus 126 between the drill string 104 and a wall of the wellbore 102. In the process, the drilling mud 120 carries cuttings 125 from the bottom of the wellbore 102 to the surface 105. At the surface 105, a separator 128 separates the cuttings 125 from the drilling mud 120 and returns the drilling mud 120 to the mud pit 122 Mud logging can be used to determine parameters of the formation from the cuttings 125 brought to the surface by the drilling mud 120.

In various embodiments, the drill string includes a bottomhole assembly (BHA) 130 that includes one or more formation evaluation sensors 132. The formation evaluation sensors 132 obtain log measurements of various parameters of the formation 108 in a process known as logging-while-drilling (LWD) or measurement-while-drilling (MWD). By measuring these parameters at various depths, a log of the formation is obtained for the parameter. Exemplary formation parameters can include, but are not limited to, horizontal stress, formation brittleness, natural fracture intensity of naturally-occurring fractures, etc. The log measurements are provided to a control unit 140. The control unit 140 includes a processor 142 and a memory storage device 144 that may include a solid-state memory device or other non-transitory storage system. The storage medium device 144 includes one or more programs 146 that can be used to perform the methods disclosed herein. The results of the one or more programs 146 can be provided to a display 150 or kept at the memory storage device 144 for later use. The processor 142 can use the log measurements in order to determine various parameters for a subsequent fracking operation in the wellbore 102, as discussed herein.

While FIG. 1 shows use of an MWD operation to determine the parameters of the formation, in other embodiments, log measurements can be obtained using a wireline device including formation evaluation sensors. The wireline device is lowered into the wellbore at some time after the drill string has been removed and the wirelines measurements can be provided to the control unit 140 or other suitable uphole controller.

Figure 2:
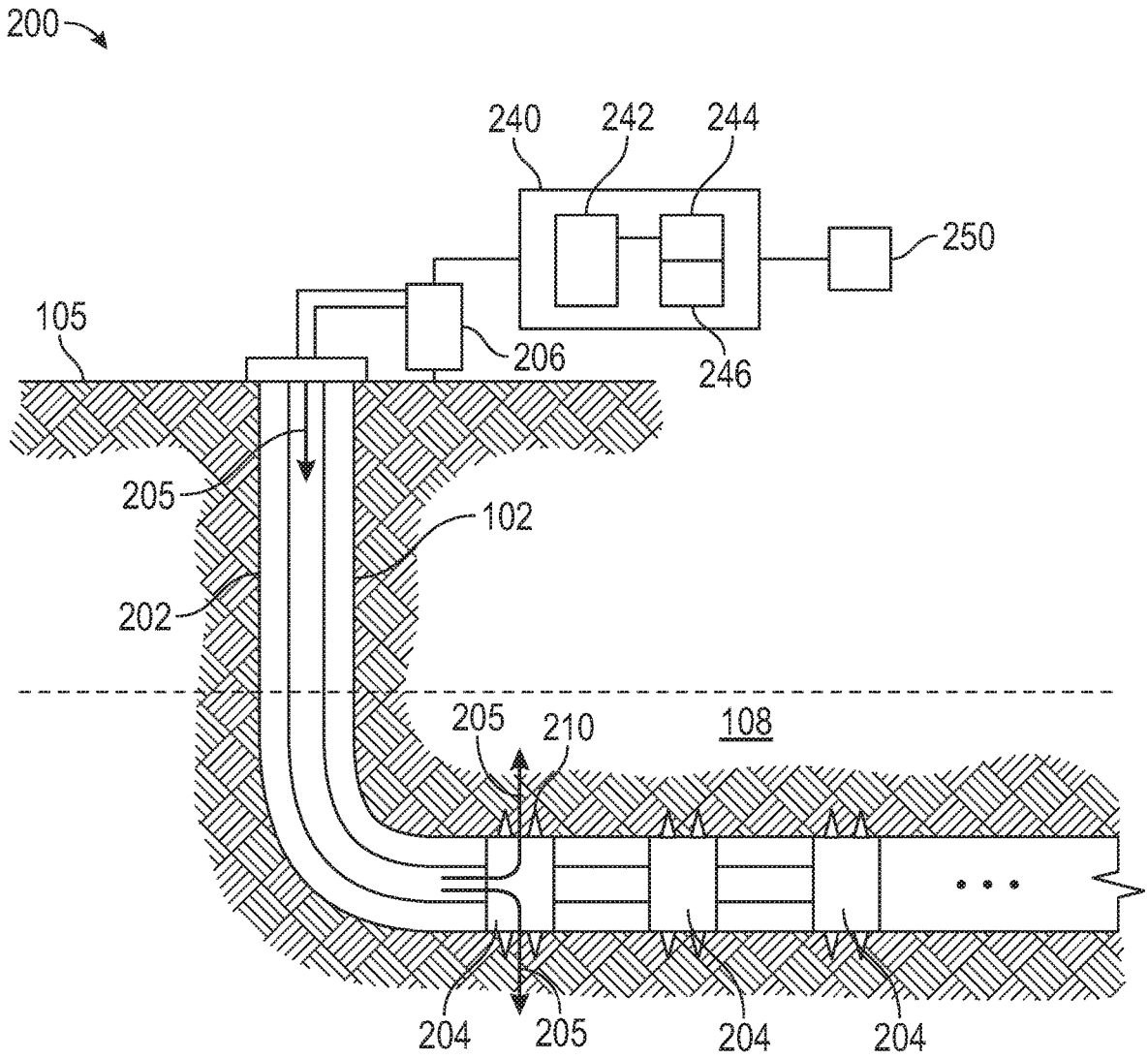
FIG. 2 shows a fracture operation being performed in the wellbore of FIG. 1.

FIG. 2 shows a fracture operation 200 being performed in the wellbore 102 of FIG. 1. During the fracture operation, a tubular 202 including one or more frac stages 204 is lowered through the wellbore 102 in order to place the frac stages 204 at selected locations within the wellbore 102. Once a frac stage 204 is set in place in the wellbore, a well injection system 206 at the surface 105 injects a frac fluid 205 downhole at high pressure. At the frac stage 204, the frac fluid 205 exits the tubular 202 into the formation 108 in order to form fissures or fractures 210 in the formation 108. The frac fluid 205 contains a proppant that is injected into the formation 108 along with the frac fluid 205. The proppant holds open the fractures 210 as the frac fluid 205 is removed, thereby allowing open channels through which formation fluid can flow into the tubular 202 and uphole to the surface 105 for processing.

A control unit 240 controls various aspects of the fracture operation including, for example, the design of the geometry of the fracture system and frac stages 204, and frac treatment parameters of the well injection system 206 such as pump rate, injection pressure, proppant type, proppant density or concentration, etc. The control unit 240 includes a processor 242 and a memory storage device 244 that may include a solid-state memory device or other non-transitory storage system. The storage medium device 244 includes one or more programs 246 that can be used to perform the methods disclosed herein. The results of the one or more programs 246 can be provided to a display 250 or kept at the memory storage device 244 for later use. The control unit 240 can be the same as the control unit 140 of FIG. 1 or in communication with the control unit 104 of FIG. 1 in order to receive data such as the results of mud logging or measurements form the formation evaluation sensors.

The fracture operation 200 can be optimized by varying several parameters of the fracture operation. For example, placement or location of a stage 204 within the wellbore 102 can impact an amount of hydrocarbons recovered from the formation. Other parameters can include a length of a stage, an inter-stage spacing, a proppant type, a proppant mass, a proppant concentration, a pump rate, a pump pressure, a surface treatment pressure, a duration of the fracking operation, etc. Although only one lateral wellbore is shown in FIGS. 1 and 2, there can be nearby lateral wellbores within the formation 108. A distance between wellbores is another parameter that affects an amount of hydrocarbons recovered from the formation.

Figure 3:
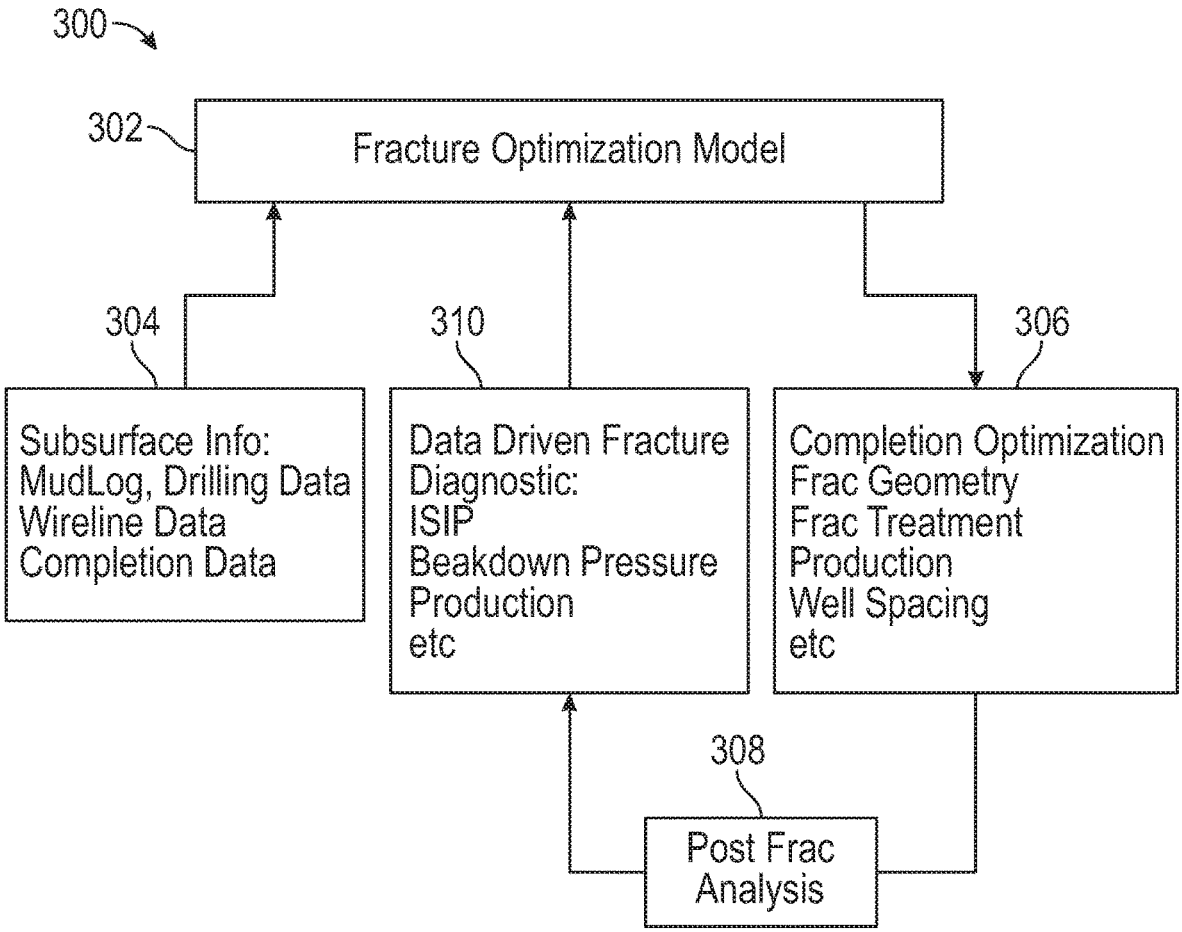
FIG. 3 shows a schematic diagram of a model operating on at least one of the processors of FIGS. 1 and 2.

FIG. 3 shows a schematic diagram 300 of a model 302 operating on at least one of the processors 142 (FIG. 1) and 242 (FIG. 2). The model 302 provides a method of designing a fracture operation or completion operation in a wellbore using logging data related to a wellbore. The model 302 further determines a correlation or relation between fracture treatment parameters and parameters of a fracture operation or completion system in order to increase or maximize an amount of hydrocarbons that are recovered from the formation. In one aspect, the model 302 receives inputs 304 about the formation type (i.e., subsurface information) from various sources such as from the downhole log measurements, mud logs and drilling data, wireline data, completion data, as well as other formation data that can be obtained prior to the fracture operation. The model 302 determines a completion optimization 306 from the inputs 304. In various embodiments, the model 302 determine a value of a parameter of the fracture operation to increase or optimize an hydrocarbons recovery from the formation. Exemplary parameters include a geometry of the fracture operation (stage placement, length, spacing etc.), frac treatment parameters, production parameters, well spacing parameters, etc.

In one aspect, the invention provides a method of designing a fracture operation includes number of stages, location of stages, stage length, intra-stage spacing etc., in order to increase, maximize or optimize an amount of hydrocarbons recovered from the formation. The design of the fracture operation employs the results of mud logging and from the logging of formation parameters using the formation evaluation sensors of either the drill string or the wireline device, as discussed with respect to FIG. 6.

In another aspect, data from the fracture operation is collected and used to determine parameters for a subsequent fracture operation so that the amount of hydrocarbons recovered during the subsequent fracture operation is increased or maximized. In a post-frac analysis 308, parameters for a fracture operation are correlated with fracture treatment parameters used during the fracture operation. In subsequent fracture operations, the processor or an operator can use real-time fracture diagnostic data 310, including instantaneous shut-in pressure, breakdown pressure production parameters, etc., with a determined relation between the parameters of the fracture diagnostic data and formation type in order to determine the type of formation being fractured. The model 302 recommends or implements an action, such as changing the fracture treatment parameters in real-time, in order to optimize or maximize an amount of hydrocarbon production by the fracture operation. As the amount of data from post-frac analysis 308 increases, the model 302 can decrease its reliance on subsurface information 304 and rely more on fracture diagnostic data 310 in order to optimize the fracture operation and recovered hydrocarbons.

Figure 4:
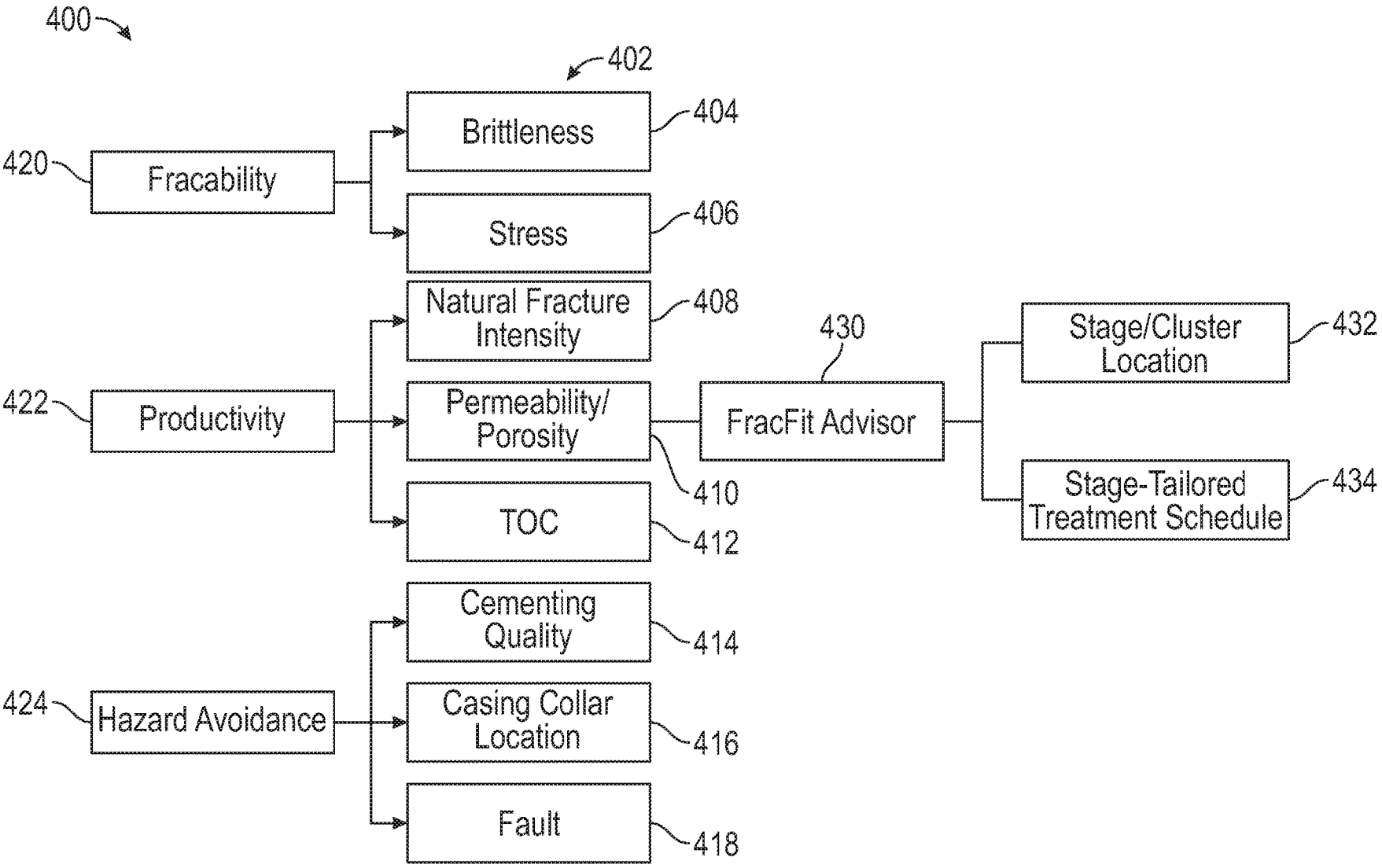
FIG. 4 shows a workflow for an optimization procedure for a fracture operation.

FIG. 4 shows a workflow 400 for an optimization procedure for a fracture operation. Column 402 includes various parameters that can be used in order to design a fracture operation. Exemplary parameters includes brittleness 404, stress 406, natural fracture intensity 408, formation permeability/porosity 410, Total Organic Carbon (TOC) 412, cementing quality 414, casing collar location 416 and fault locations 418. These parameters are provided to the model 302 which designs the fracture operation. In one aspect, the model 302 determines geometrical parameters 432 of the fracture system, such as a number of stages, a location of the stages, intra-stage spacing. In another aspect, the model 302 determines a treatment schedule 434 to be used for the fracture operation.

Parameters such as brittleness 404, stress 406 and natural fracture intensity 408 are fracability parameters 420 of a formation. The parameters of natural fracture intensity 408, permeability/porosity 410 and TOC 412 are productivity parameters 420 of the formation. The parameters of cementing quality 414, casing collar location 416 and fault locations 418 are hazard avoidance parameters 424. During early-occurring aspects of the fracture operation, the model 302 may rely mostly on the fracability parameters 420 in order to determine fracture operation parameters such as geometrical parameters 432. As the other parameters become available to the model 302, the model 320 can incorporate these parameter in its calculations, thereby aiding in determining fracture operation parameters such as treatment schedule parameters 434, etc.

The fracability parameters 420 can be used to identify a minimum and a maximum stage length using a clustering of perforations. The model 302 can cluster perforations having a minimum horizontal stress within a selected criterion (e.g., <200 psi) of each other, or within a selected brittleness criterion (e.g., <20). Also, the model 302 can group stages together that have a same natural fracture intensity, within a selected criterion. The completion system can be designed so that a stress contrast between stages is used as barriers to limit hydraulic fracture migration into a stage. A selected stage cluster can maintain comparable perforation sand erosion across the cluster.

The productivity parameters 422 can be used to place fracture stages away from geohazards such as faults or locations of potential fracture migration that can limited stimulated reservoir volume or connect with aquifers.

A completed wellbore can be compared with post-frac analysis in order to design a stage-tailored fracture treatment plan. For example, a proppant mesh size and proppant type can be selected based on proppant embedment results. Also a fracture schedule can be designed based on a natural fracture intensity. The model 302 can thus anticipate difficulties in stage placement in ductile zones and/or stress zones.

Figure 5:
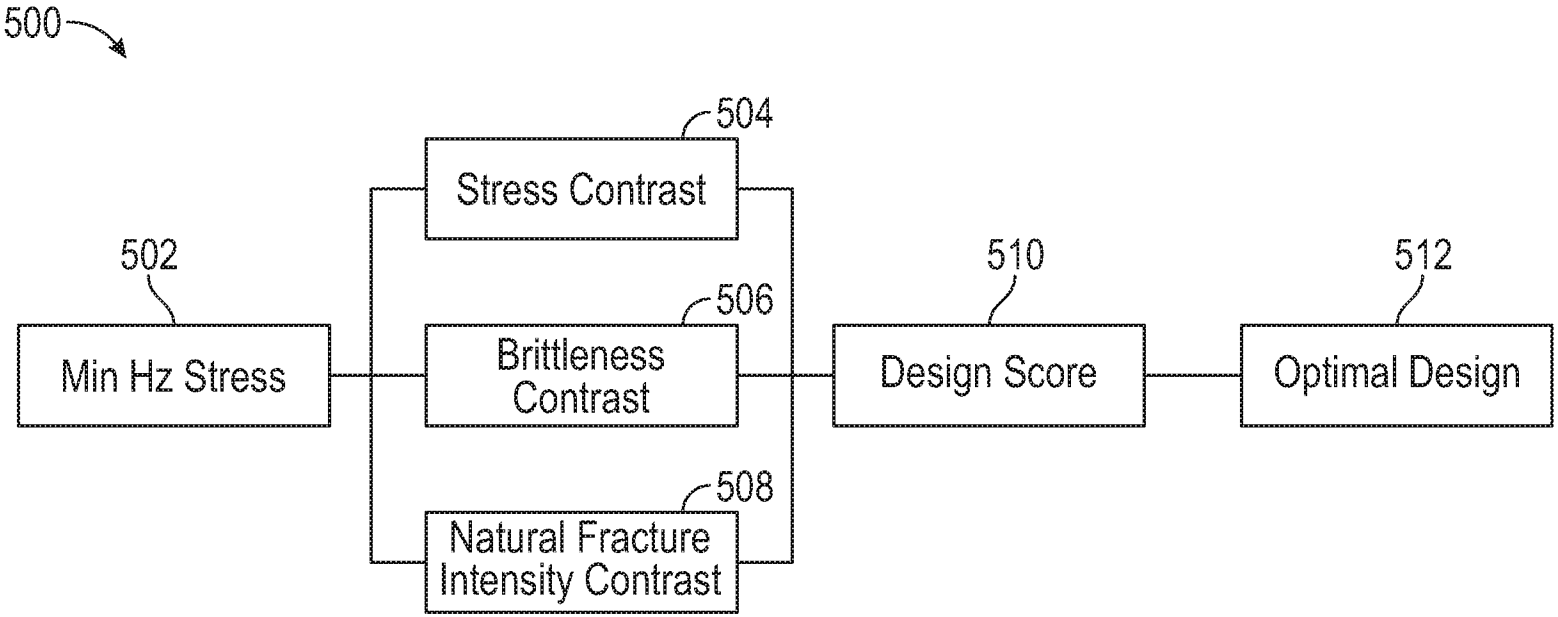
FIG. 5 shows a detailed workflow for providing an optimal design for a fracture operation.

FIG. 5 shows a detailed workflow 500 for providing an optimal design for a fracture operation. The minima of the horizontal stress 502 can be used to identify possible fracture locations and to provide a proposed design for a completion. For the proposed completion design, the stress contrast 504, brittleness contrast 506 and natural fracture intensity contrast 508 are used in order to create a design score 410 for the proposed completion design. This process can be performed for other proposed completion designs. The design scores 510 for the plurality of proposed completion designs are then used to select an optimal completion design 512.

Figure 6:
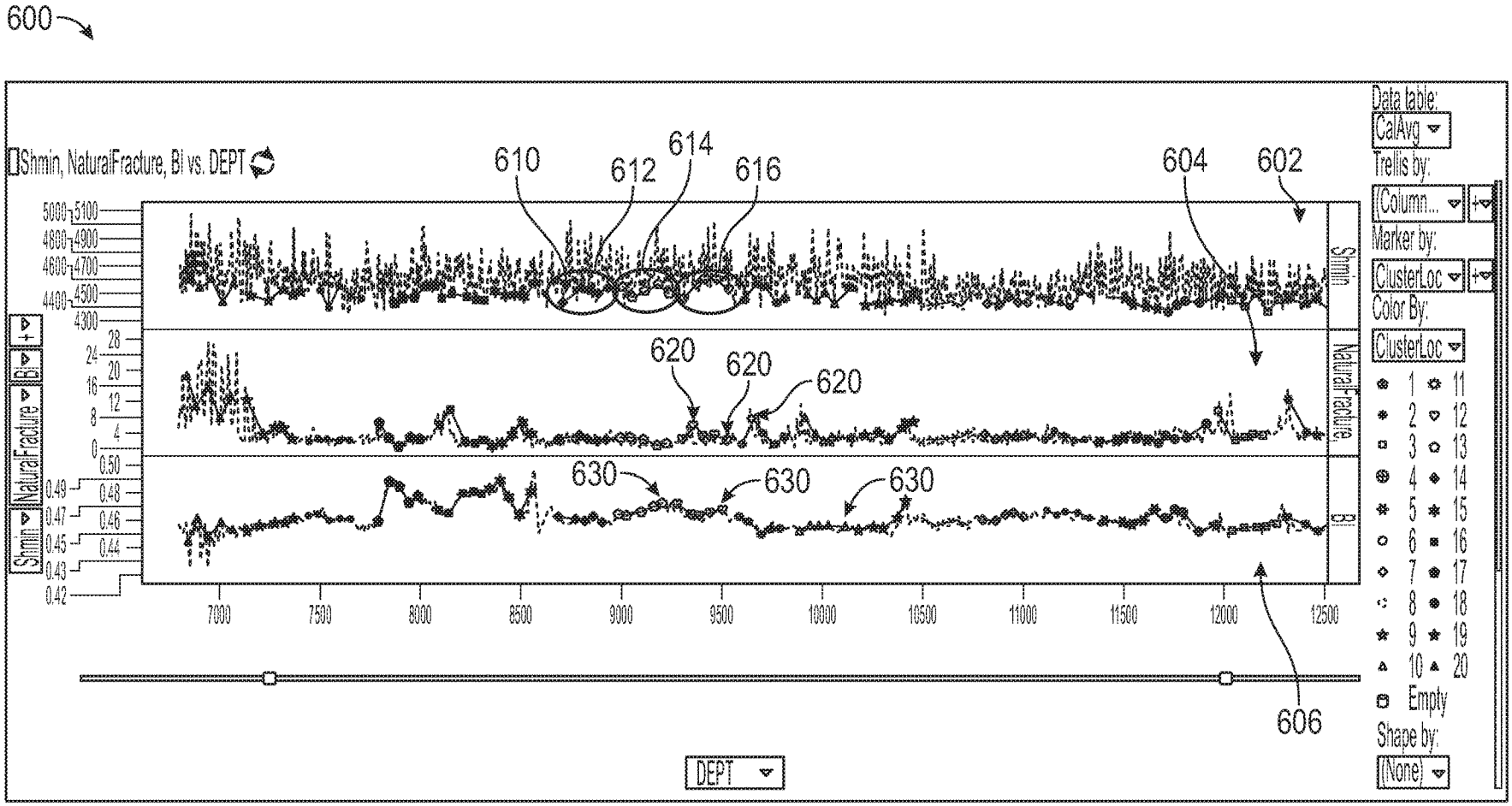
FIG. 6 shows depth-correlated log measurements suitable for designing a geometry of a fracture operation in one embodiment.

FIG. 6 shows depth-correlated log measurements 600 suitable for designing a geometry of a fracture operation in one embodiment. The log measurements 600 include a horizontal stress log 602, a natural fracture intensity log 604 and a brittleness index (BI) log 604. When considering placement of a stage of a fracture operation, a location having a low or minimum horizontal stress is desirable. Also, a location having a high natural fracture intensity and/or a location having a high brittleness index is desirable. In one embodiment, the processor (142, 242) determines a location of one or more local minima 610 of the horizontal stress from the horizontal stress log 602. The processor then groups the minima into a plurality of clusters, as illustrated by representative clusters 612, 614 and 616. A selected cluster (e.g., cluster 612) indicates a location at which to place a frac stage (204, FIG. 2), as well as frac stage length and inter-stage spacing, etc. In determining the location of the one or more frac stages 204, the processor can further consider the local maxima 620 of the natural fracture intensity as well as the local maxima 630 of the brittleness index. Locations with high natural fracture intensity are desirable locations for stage placement as are locations with high brittleness index.

In another aspect, the invention allows for real-time alteration of a stimulation parameter in order to increase or optimize a hydrocarbons recovery from the formation. A post-frac analysis of previous fracture operations are used to determine a relation or correlation between stimulation parameters and the type of formation or rock being fractured. Using the correlation between stimulation parameters and formation type, the operator can then determine a formation type from the stimulation parameters. From this determined formation type, the operator can then change or alter the stimulation parameter. In particular, the formation type can be provided to a model that indicates a new value for the stimulation parameter in order to increase hydrocarbons production based on the determined formation type. This process eliminates or reduces the need to have subsurface formation characterization logging tools in the wellbore or prior knowledge of the formation type.

Figure 7:
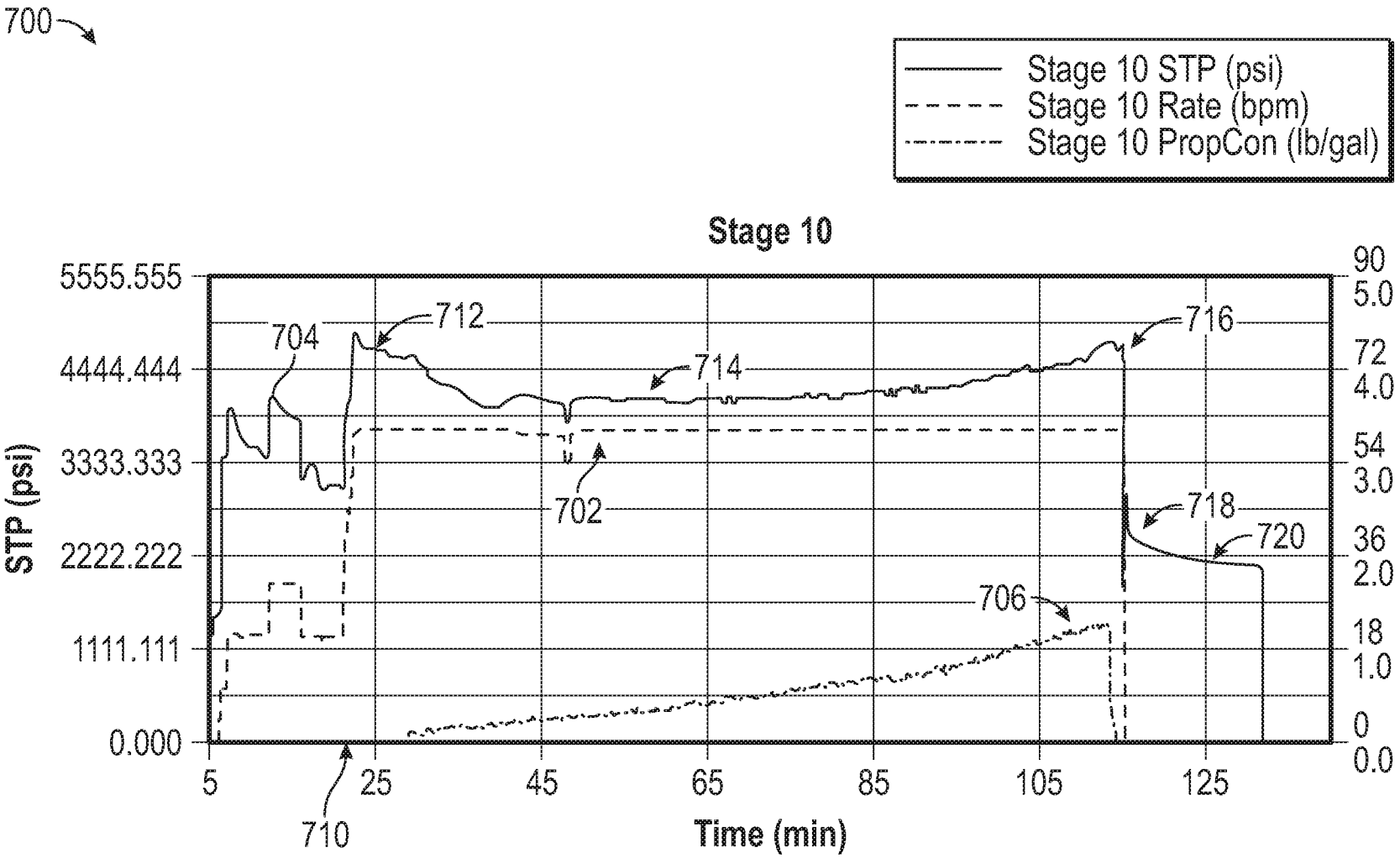
FIG. 7 depicts a time-evolution of illustrative fracture treatment parameters used in a fracture operation.

FIG. 7 depicts a time-evolution of illustrative fracture treatment parameters used in a fracture operation. The fracture treatment parameters include a pump rate 702, a surface treatment pressure (STP) 704, and a proppant concentration 706. Time is shown in minutes along the x-axis. A scale for STP 704 is provided along the left side of the graph in pounds per square inch (psi). A scale for pump rate is shown along the right side of the graph (0 through 80) in barrels per min (bpm)) and a scale for proppant concentration is also shown along the right side of the graph (0 through 5) in pounds/gallon. The values of the fracture treatment parameters are shown for a duration of a fracture operation.

The STP 704 shows an increase during a first stage until it reaches a breakdown pressure 712. A breakdown pressure is a pressure at which the rock matrix of the formation fractures and allows the frac fluid to be injected. Between the moment of breakdown (at about t=20 minutes) to the moment of shut-in (at about t=115 minutes) the STP 712 displays an average STP 714. At shut-in, the STP 704 changes abruptly form a final pressure 716 to an instantaneous shut-in pressure (ISIP) 718, following by a duration of time in which the STP 704 displays a leak-off pressure 720.

The pump rate 702 is a controlled parameter of the frac operation. During the first stage (prior to the breakdown), the pump rate 702 is increased in order to force a breakdown of the formation. After the breakdown, the pump rate 702 holds steady at a more or less constant rate. Turning off the pump (at about t=115 minutes) reduces the pump rate to zero. Proppant concentration 706 increases over the interval between breakdown and shut-in a substantially linear fashion.

In a post frac analysis, the processor (142, 242) can determine or estimate characteristic values of the fracture treatment parameters such as the breakdown time, breakdown pressure, ISIP, pump rate, etc. These values can be correlated to formation properties (which are determined from subsurface logs, mud logging, etc.) in order to form a model that allows identification of the formation type by observing the values of the fracture treatment parameters.

Figure 8:
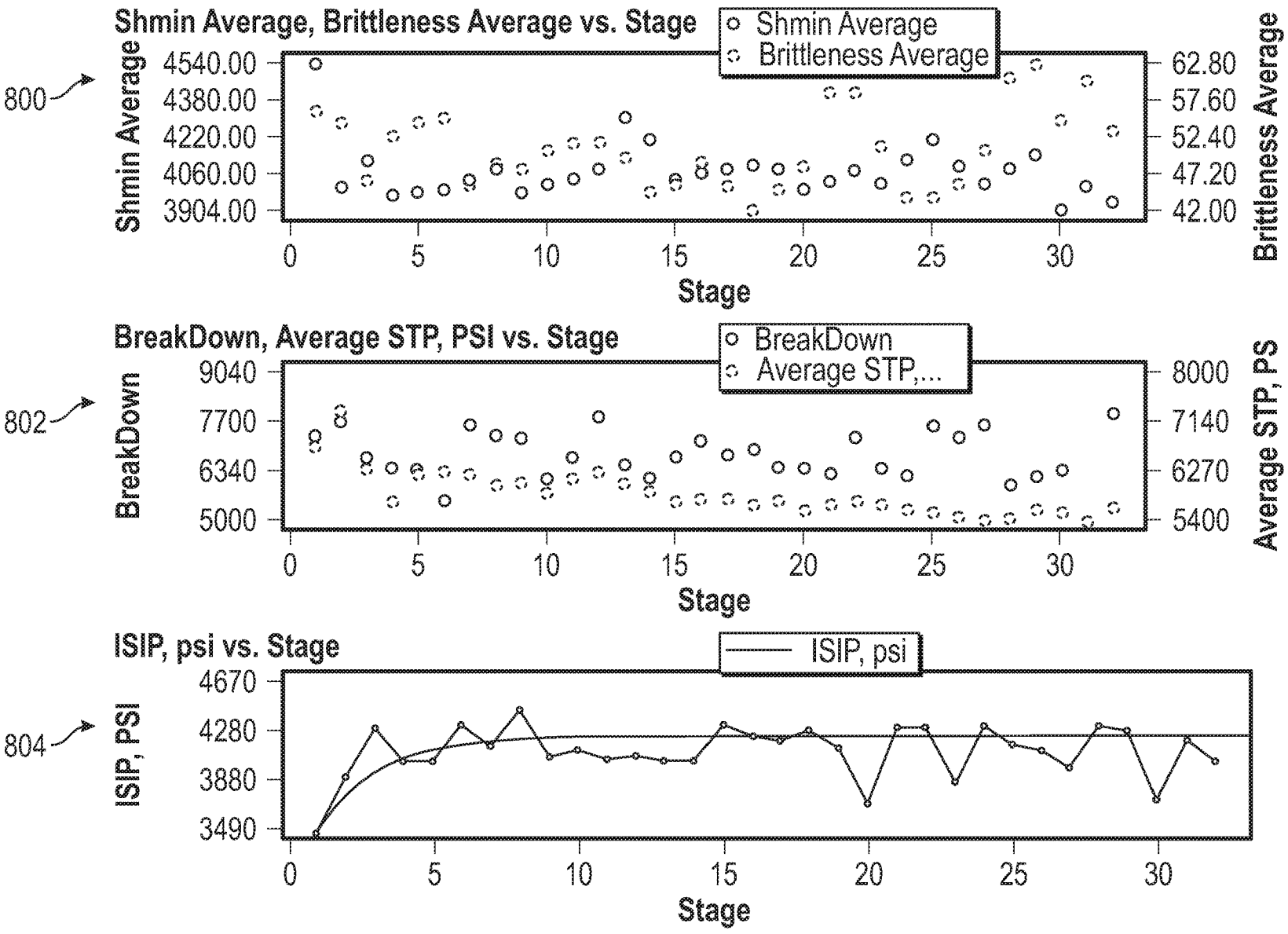
FIG. 8 shows values of various fracture treatment parameters obtained during a fracture operation.
Figure 9:
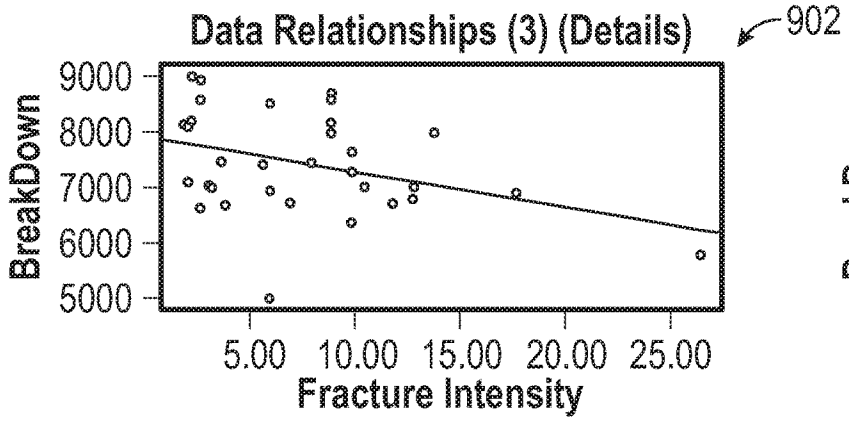
FIG. 9 shows multivariable analyses providing correlations amongst the various parameters of FIG. 8.
Figure 9:
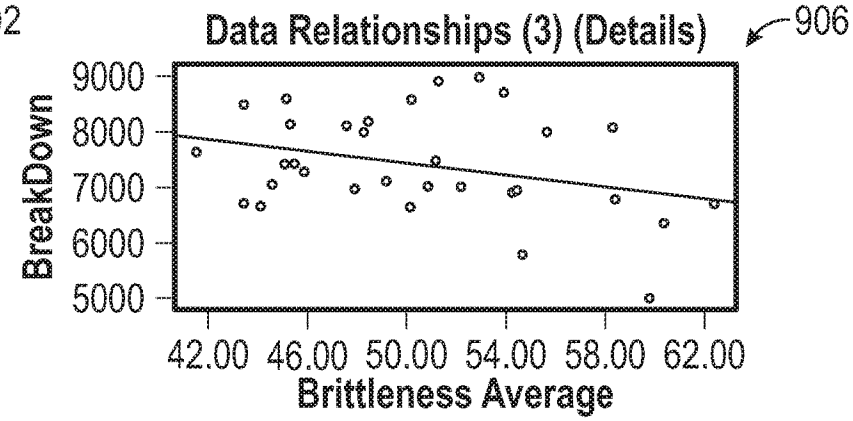
Figure 9:
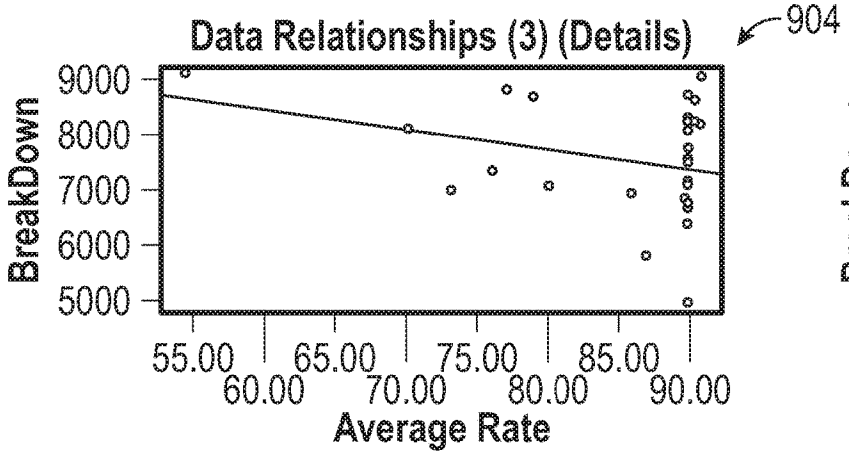
Figure 9:
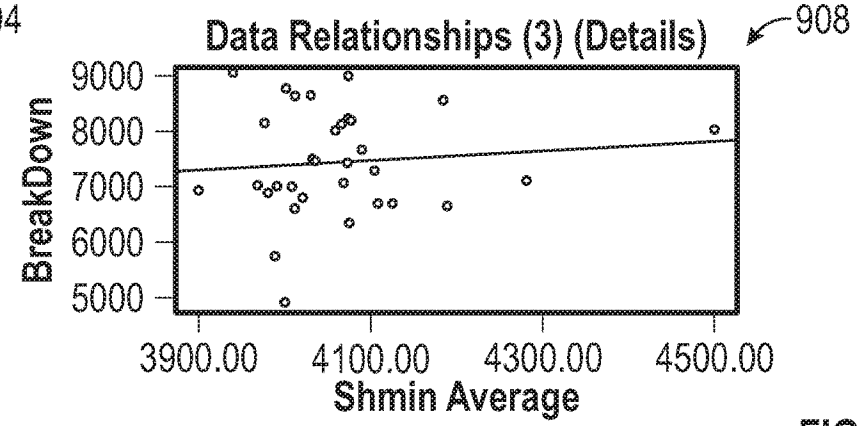

FIGS. 8 and 9 illustrate a post-frac analysis of the formation. FIG. 8 shows values of various fracture treatment parameters obtained during a fracture operation. Values are shown for a plurality of stages. A top graph 800 shows average minimum values of horizontal stress and an average brittleness index for each stages of the previous fracture operation. A middle graph 802 shows values of the breakdown pressure and average surface treatment pressure (STP) for each stage. A bottom graph 804 shows values of instantaneous shut-in pressure (ISIP) for each stage.

FIG. 9 shows multivariable analyses providing correlations amongst the various parameters of FIG. 8. First graph 900 shows a correlation between breakdown pressure and fracture intensity. Second graph 902 shows a correlation between breakdown pressure and average pump rate. Third graph 904 shows a correlation between breakdown pressure and average brittleness index. Fourth graph 906 shows a correlation between breakdown pressure and minimum horizontal stress. The correlations can be determined using a suitable linear regression process. The post frac analysis provides information about downhole stress and fracture geometry from values of the fracture treatment properties.

FIGS. 10-15 shows relations that can be determined between fracture treatment parameters and downhole formation parameters using the methods disclosed herein.

Figure 10:
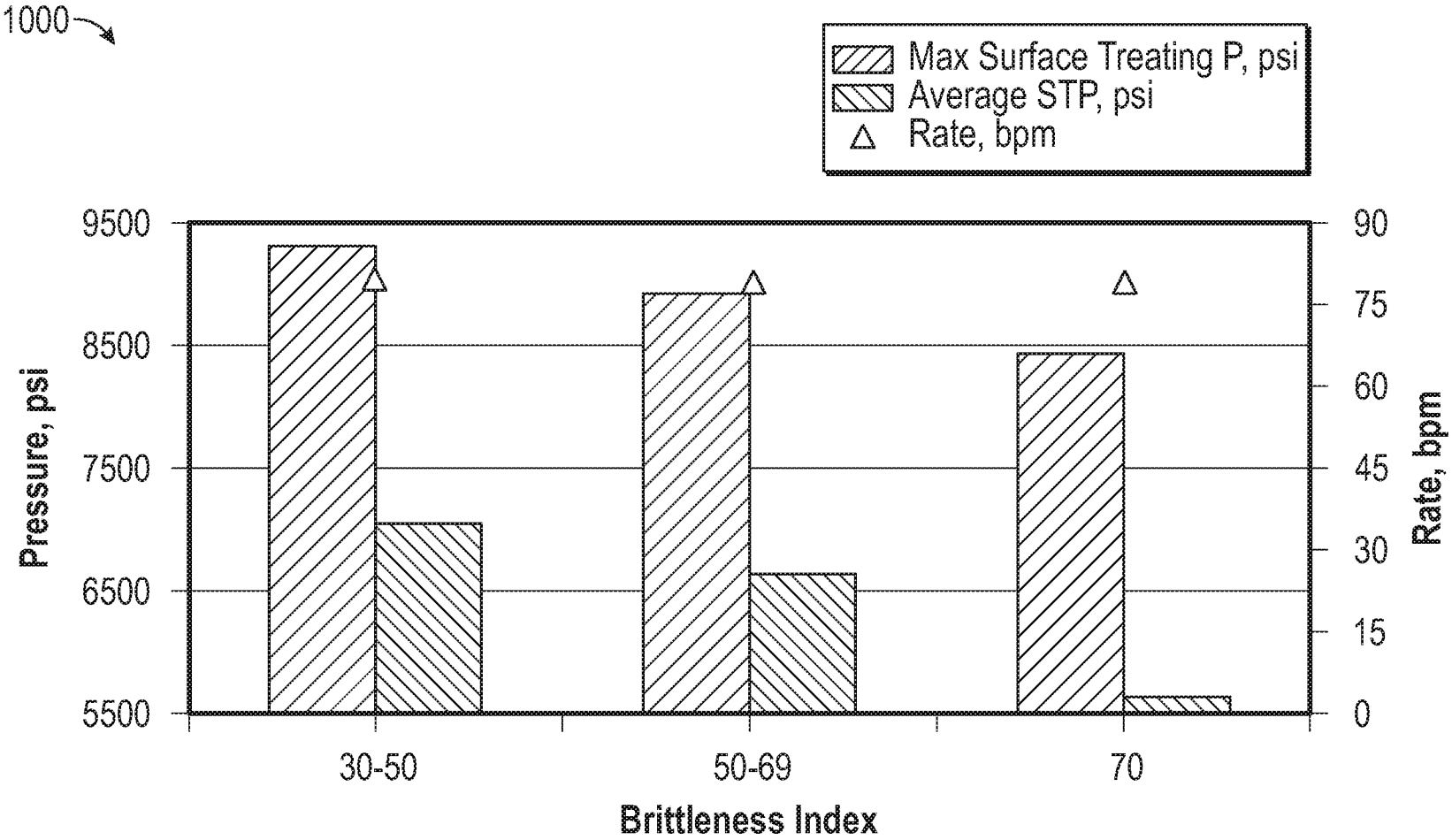
FIG. 10 shows a graph illustrating a relation between various treatment parameters and a brittleness index of a formation.

FIG. 10 shows a graph 1000 illustrating a relation between various treatment parameters and a brittleness index of a formation. The brittleness index (BI) is shown along the x-axis, while a scale for pressure (in psi) is shown along the left side of the graph 1000 and a scale for pump rate (in bpm) is shown along the right side of the graph 1000. The lower the brittleness index, the less brittle (or more ductile) is the formation. The graph 1000 shows a first brittleness group for formations having a BI between 30 and 50, a second brittleness group for formations having a BI between 50 and 69, and a third brittleness group for formations having a BI of 70. The maximum surface treating pressure is shown to be highest for relatively ductile formations (i.e., the first brittleness group) and decreases as the brittleness formation increases. Similarly, the average STP is highest for relatively ductile formations and decreases as the brittleness of the formation increases. The pump rate is relatively unaffected by the brittleness of the formation.

Figure 11:
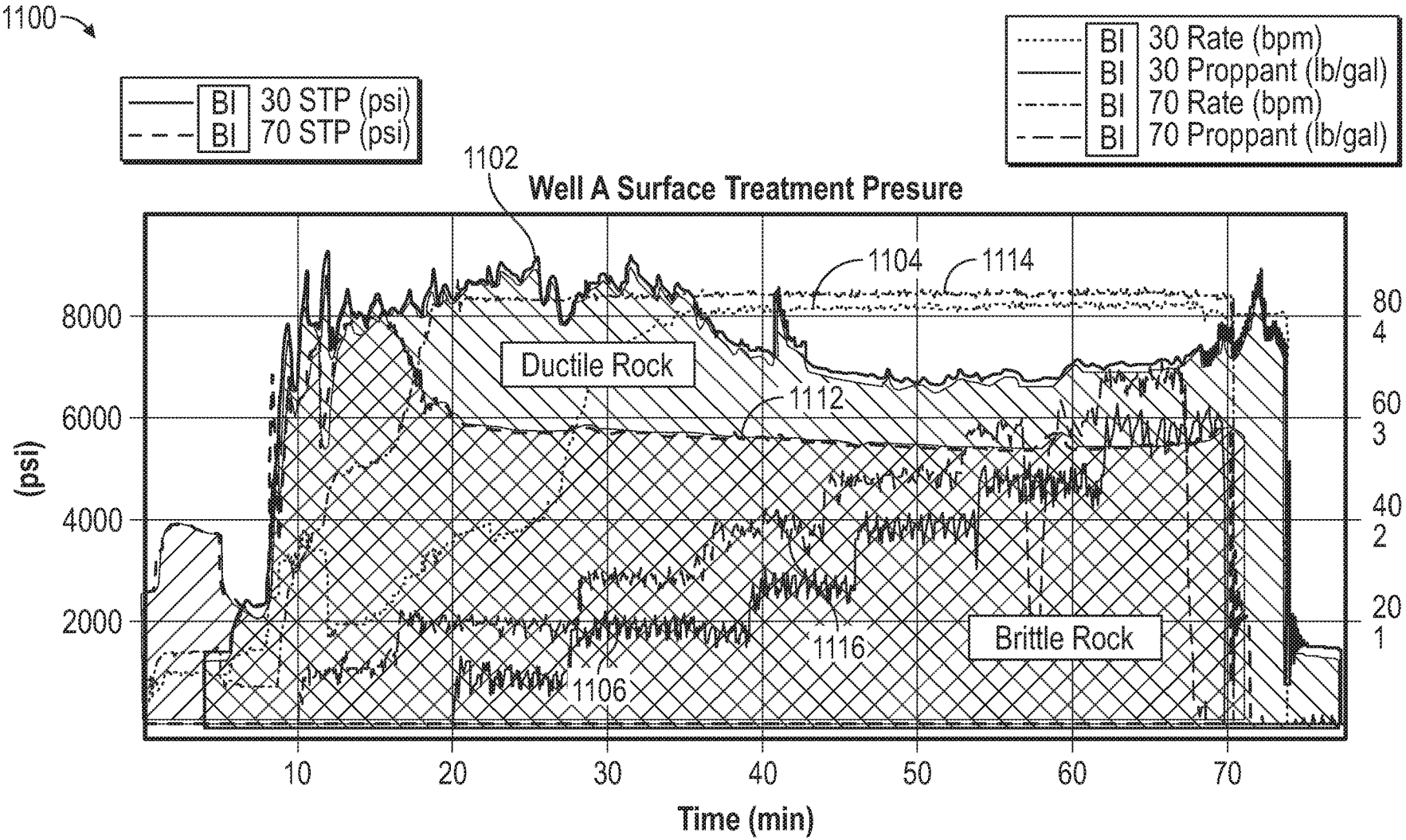
FIG. 11 shows a time evolution of various surface treatment parameters during a fracture operation for formations having different brittleness or ductility.

FIG. 11 shows a time evolution of various surface treatment parameters during a fracture operation for formations having different brittleness or ductility. For a ductile formation surface treatment pressure 1102, pump rate 1104 and proppant concentration 1106 are shown. Similarly for a brittle formation, surface treatment pressure 1112, pump rate 1114 and proppant concentration 1116 are shown. The surface treatment pressure 1102 for the ductile formation rises to a breakdown pressure and about t=8 mins and thereafter maintains a high average STP of about 8000 psi until the time of shut-in (about t=75 mins). For the brittle formation, the average STP is significantly lower, i.e., about 6000 psi. The pump rate 1104 for the ductile formation reaches its maximum value of about 80 bpm at about t=35 minutes, or about 30 minutes after the breakdown time. On the other hand, the pump rate 1114 for the brittle formation rises much faster than does the pump rate 1104. The pump rate 1114 reaches its maximum value of about 85 bpm at about t=18 minutes, which is about 10 minutes after the breakdown time. The proppant concentration 1106 for the ductile formation rises in a step-like fashion during the frac operation. The proppant concentration 1116 for the brittle formation also rises in a step-like fashion. However, the proppant concentration 1116 increases at an earlier time as does the proppant concentration 1106 and reaches a higher concentration value at the time of shut-in.

Figure 12:
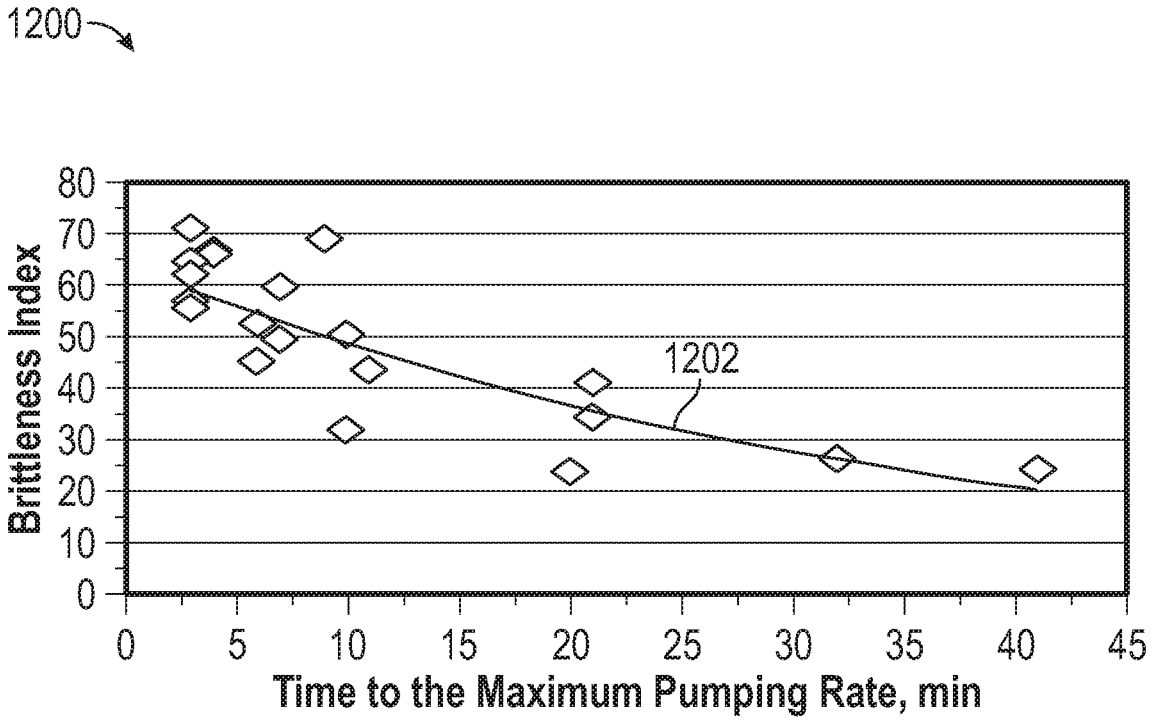
FIG. 12 shows a relation between the brittleness index and a time to maximum pumping rate.

FIG. 12 shows a relation 1200 between the brittleness index and a time to maximum pumping rate, which can be determined by observing pump rates, as illustrated in FIG. 11. The analysis curve 1202 for several points shows how the time to maximum pumping rate increases with ductility or decreases with brittleness.

Figure 13:
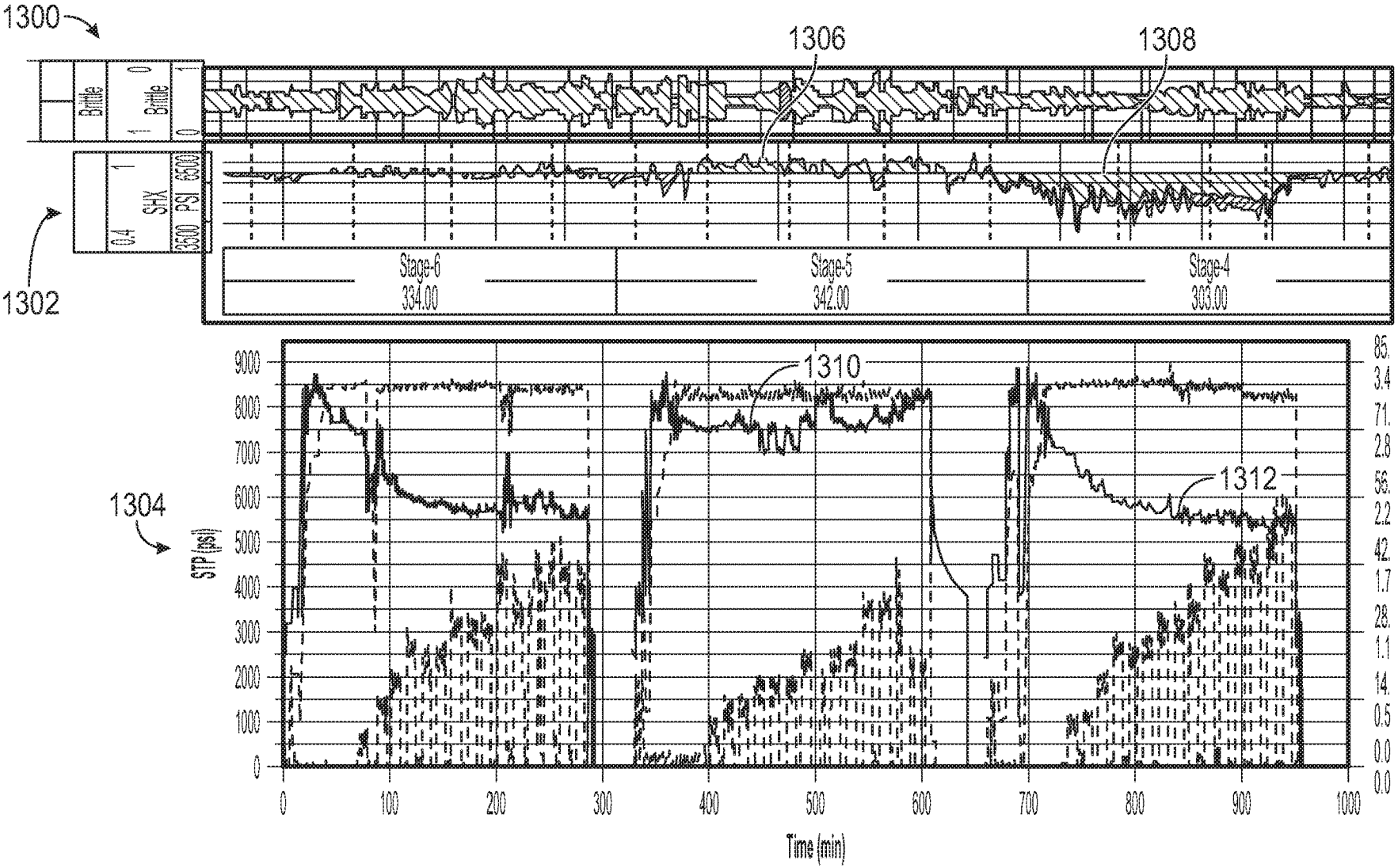
FIG. 13 illustrates a relation between horizontal stress in a formation and various fracture treatment parameters.

FIG. 13 illustrates a relation 1300 between horizontal stress in a formation and various fracture treatment parameters. A horizontal stress log 1302 shows the horizontal stress across three stages (stage 4, stage 5, stage 6) of a fracture operation. For each stage, graphs 1304 showing the time-evolution of STP, pumping rate and proppant concentration are shown. The section of the horizontal stress log 1302 associated with Stage 5 shows areas of high horizontal stress 1306. The section of the horizontal stress log 1302 associated with Stage 4 shows areas of low horizontal stress. Observing the graph for stage 5, the average STP 1310 remains a relatively high (and near its maximum pressure value during the time between breakdown and shut-in. Observing the graph for stage 6, the STP 1312 droops significantly from its maximum pressure at breakdown to its final pressure at shut-in, having an average value of STP 1312 that is significantly less than the maximum pressure value. Therefore, a high average STP 1310 can be associated with high horizontal stress values 1306 while low average STP 1312 can be associated with low horizontal stress values 1308.

Figure 14:
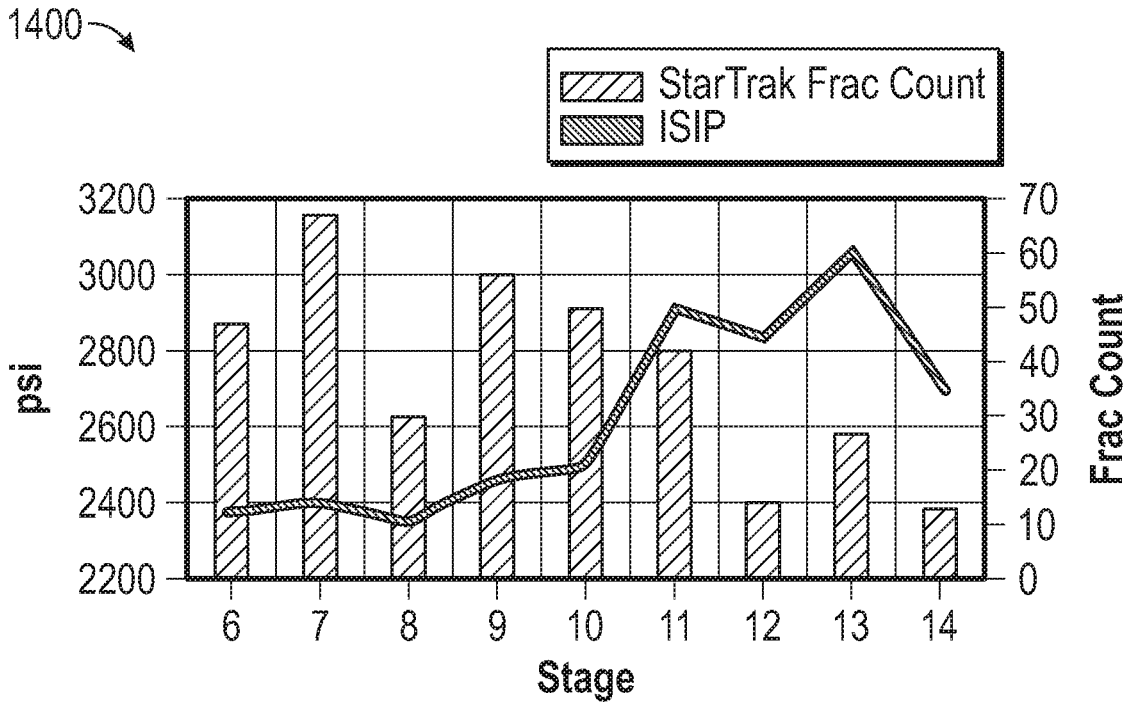
FIG. 14 shows a chart depicting an instantaneous shut-in pressure (ISIP) and a natural fracture intensity for several stages of a fracture operation.
Figure 15:
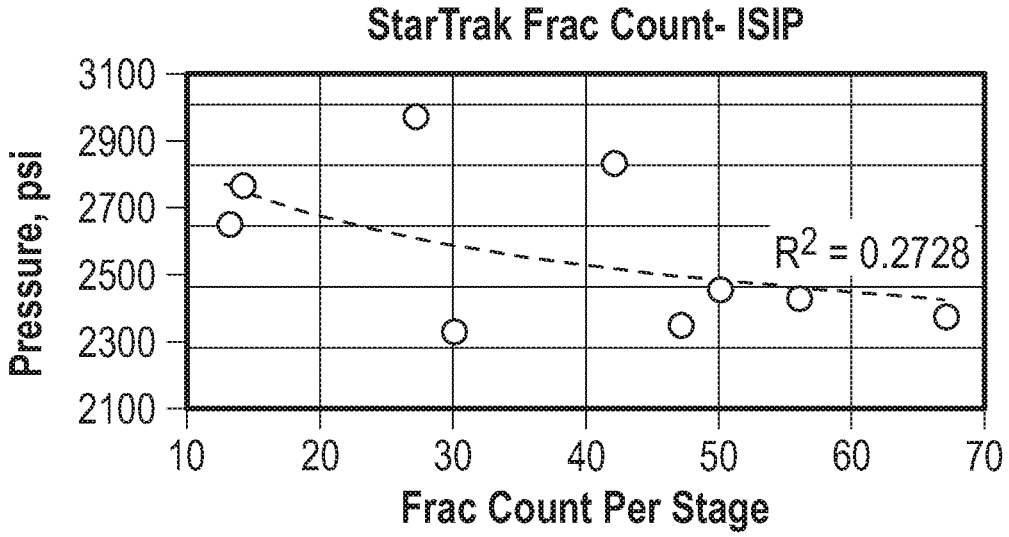
FIG. 15 shows multivariable analysis of the data of FIG. 14 that provides a relation between the number natural fractures per and the ISIP.

FIG. 14 shows a chart 1400 depicting an ISIP and a natural fracture intensity for several stages of a fracture operation. FIG. 15 shows multivariable analysis performed using the data of chart 1400 in order to determine a relation between the number natural fractures per and the ISIP.

By being able to design a fracture operation or fracture system using the methods disclosed herein, various operational efficiencies are employed, for example, by placing a stage at a location having a highest expected hydrocarbons recovery. Costs are reduced by preventing the need to move stages or relocate them. Additionally, the time required in order to plan and execute the fracture system is reduced leading to accelerated field development.

Set forth below are some embodiments of the foregoing disclosure:

Embodiment 1

A method for performing a fracture operation, comprising: obtaining a log of a formation parameter for a formation surrounding a wellbore in which the fracture operation is to be implemented; determining a relation between the formation parameter and a parameter of the fracture operation; and selecting a value of the parameter of the fracture operation based on the relation and a value of the formation parameter.

Embodiment 2

The method of any previous embodiment, further comprising determining local extrema for the formation parameter at a plurality of depths, and clustering the local extrema to determine the parameter of the fracture operation.

Embodiment 3

The method of any previous embodiment, further comprising determining, from a cluster for a plurality of local minima of the horizontal stress, at least one of: (i) a location of a frac stage; (ii) a length of a frac stage; and (iii) a spacing between frac stages.

Embodiment 4

The method of any previous embodiment, wherein determining the cluster further comprises determining a local maximum of a brittleness index of the formation and a local maximum of the natural fracture intensity of the formation.

Embodiment 5

The method of any previous embodiment, wherein the formation parameter comprises at least one of: (i) a horizontal stress of the formation; (ii) a brittleness of the formation; (iii) a natural fracture intensity of the formation and (iv) available subsurface data including at least one of (a) mud logging data, (b) logging-while-drilling data, and cuttings analysis.

Embodiment 6

The method of any previous embodiment, wherein the parameter of the fracture operation includes a fracture treatment parameter, further comprising: determining a relation between the fracture treatment parameter of and the formation parameter; determining, from the relation and a value of the formation parameter, a value of the fracture treatment parameter; and performing the fracture operation using the determined value of the fracture treatment parameter.

Embodiment 7

The method of any previous embodiment, wherein the fracture treatment parameter includes at least one of: (i) an inter-stage spacing; (ii) a stage length; (iii) a stage location; (iv) a proppant type; (v) a proppant mass; (vi) a proppant concentration; (vii) a pump rate; (viii) a surface treatment pressure; (ix) a breakdown pressure; (x) an instantaneous shut-in pressure; and (xi) an average surface treatment pressure.

Embodiment 8

The method of any previous embodiment, further comprising determining the relation from a post-frac analysis from a separate wellbore.

Embodiment 9

A method of performing a fracture operation, comprising: determining a relation between a fracture treatment parameter of the fracture operation and a formation parameter; determining, from the relation and a first value of the fracture treatment parameter, a value of the formation parameter; determining from the formation parameter a second value of the fracture treatment parameter; and altering the fracture treatment parameter from the first value to the second value.

Embodiment 10

The method of any previous embodiment, wherein a hydrocarbon recovery of the fracture operation using the second value of the fracture treatment parameter is greater than a hydrocarbon recovery using the first value of the stimulation parameter.

Embodiment 11

The method of any previous embodiment, wherein the formation parameter is indicated of a formation type, further comprising determining the second value of the fracture treatment parameter based on the formation type.

Embodiment 12

The method of any previous embodiment, further comprising determining the relation using measurements from a previously performed fracture operation.

Embodiment 13

The method of any previous embodiment, wherein the fracture treatment parameter includes at least one of: (i) an inter-stage spacing; (ii) a stage length; (iii) a stage location; (iv) a proppant type; (v) a proppant mass; (vi) a proppant concentration; (vii) a pump rate; (viii) a surface treatment pressure; (ix) a breakdown pressure; (x) an instantaneous shut-in pressure; and (xi) an average surface treatment pressure.

Embodiment 14

The method of any previous embodiment, further comprising altering the fracture treatment parameter from the first value to the second value during a frac operation.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method for performing a fracture operation, comprising:

obtaining, at a processor, a log of a formation parameter for a formation surrounding a wellbore in which the fracture operation is to be implemented;

determining, at the processor, a relation between the formation parameter and a parameter of the fracture operation;

determining, at the processor, local extrema for the formation parameter at a plurality of depths;

grouping, at the processor, the local extrema into a cluster to determine a value for the parameter of the fracture operation; and creating a frac stage with the determined value.

2. The method of claim 1, further comprising determining, from the cluster for a plurality of local minima of the horizontal stress, at least one of: (i) a location of a frac stage; (ii) a length of a frac stage; and (iii) a spacing between frac stages.

3. The method of claim 2, wherein determining the cluster further comprises determining a local maximum of a brittleness index of the formation and a local maximum of the natural fracture intensity of the formation.

4. The method of claim 1, wherein the formation parameter comprises at least one of: (i) a horizontal stress of the formation; (ii) a brittleness of the formation; (iii) a natural fracture intensity of the formation and (iv) available subsurface data including at least one of (a) mud logging data, (b) logging-while-drilling data, and cuttings analysis.

5. A method of performing a fracture operation, comprising:

obtaining, at a processor, a log of a formation parameter for a formation surrounding a wellbore in which the fracture operation is to be implemented;

determining, at the processor, a relation between a fracture treatment parameter and the formation parameter;

determining, at the processor, a value of the fracture treatment parameter from the relation and a value of the formation parameter; and performing, at the processor, the fracture operation using the determined value of the fracture treatment parameter.

6. The method of claim 5, wherein the fracture treatment parameter includes at least one of: (i) an inter-stage spacing; (ii) a stage length; (iii) a stage location; (iv) a proppant type; (v) a proppant mass; (vi) a proppant concentration; (vii) a pump rate; (viii) a surface treatment pressure; (ix) a breakdown pressure; (x) an instantaneous shut-in pressure; and (xi) an average surface treatment pressure.

7. The method of claim 5, further comprising determining the relation from a post-frac analysis from a separate wellbore.

8. A method of performing a fracture operation, comprising:

determining, at a processor, a relation between a fracture treatment parameter of the fracture operation and a formation parameter;

determining, at the processor, from the relation and a first value of the fracture treatment parameter during the fracture operation, a value of the formation parameter;

determining, at the processor, from the formation parameter a second value of the fracture treatment parameter of the fracture operation that increases a hydrocarbon production for the formation type; and altering the fracture treatment parameter during the fracture operation from the first value to the second value.

9. The method of claim 8, wherein a hydrocarbon recovery of the fracture operation using the second value of the fracture treatment parameter is greater than a hydrocarbon recovery using the first value of the stimulation parameter.

10. The method of claim 8, wherein the formation parameter is indicated of a formation type, further comprising determining the second value of the fracture treatment parameter based on the formation type.

11. The method of claim 8, further comprising determining the relation using measurements from a previously performed fracture operation.

12. The method of claim 8, wherein the fracture treatment parameter includes at least one of: (i) an inter-stage spacing; (ii) a stage length; (iii) a stage location; (iv) a proppant type; (v) a proppant mass; (vi) a proppant concentration; (vii) a pump rate; (viii) a surface treatment pressure; (ix) a breakdown pressure; (x) an instantaneous shut-in pressure; and (xi) an average surface treatment pressure.

* * * * *